United States Patent [19]

Waldeck

[11] Patent Number: 4,907,705

[45] Date of Patent: Mar. 13, 1990

[54] DISPLAY CASE

[76] Inventor: William D. Waldeck, 210 Main St., Belpre, Ohio 45714-0508

[21] Appl. No.: 355,258

[22] Filed: May 22, 1989

[51] Int. Cl.[4] ..... A47F 7/00

[52] U.S. Cl. ..... 211/13; 211/72; 248/174

[58] Field of Search ..... 211/71, 72, 73, 74, 211/60.1, 13, 70.1; 248/174

[56] References Cited

U.S. PATENT DOCUMENTS

| | | | |
|---|---|---|---|
| D. 288,482 | 2/1987 | Blatherwick et al. | D24/31 |
| 1,818,247 | 8/1931 | Grennan . | |
| 2,217,953 | 10/1940 | Igou | 206/45 |
| 2,355,206 | 8/1944 | Davidson, Jr. | 229/34 |
| 2,568,677 | 9/1951 | Adelson | 211/72 |
| 3,184,071 | 5/1965 | Delaire | 211/74 |
| 3,295,671 | 1/1967 | Wuensch et al. | 206/44 |
| 3,300,055 | 1/1967 | Rohr | 211/74 |
| 4,453,639 | 6/1984 | Sharma | 211/74 |
| 4,488,654 | 12/1984 | Odsgard | 211/73 X |

*Primary Examiner*—Robert W. Gibson, Jr.
*Attorney, Agent, or Firm*—John L. Gray

[57] ABSTRACT

A display case comprising a vertical back portion, lower and upper downwardly sloping display racks attached to said vertically extending member and supported by a base member which is also connected to the lower portion of said back member, said upper display rack being provided with a parallel display rack thereover provided with a plurality of openings therein.

7 Claims, 2 Drawing Sheets

DISPLAY CASE

BACKGROUND OF THE INVENTION

Display cases, especially for muffins and cakes and other baked goods, usually are made of cardboard which can be unfolded to form a box configuration to form a display case. These are not particularly attractive and they are not sturdy and are disposed of when the contents have been sold. Examples of display cases of this type are U.S. Pat. No. 1,818,247, Grennan, U.S. Pat. No. 2,355,206, Davidson, Jr., and U.S. Pat. No. 2,217,953, Igou.

SUMMARY OF THE INVENTION

Applicant's invention is a sturdy, permanent, one-piece display case which attractively displays products to be sold. It is especially useful for baked goods with an upper portion providing a series of openings to receive muffins and the like but which can also receive other articles that would fit therein and which in turn could be supported by a complementary parallel portion immediately therebelow. Underneath this upper display area, which comprises two parallel display portions, there is another sloped display area for other products such as small baked loaves or cakes. Preferably, but not necessarily, the entire device is made of a clear plastic material such as a Plexiglas® sheet which provides an attractive, readily cleaned, display of the contents placed thereon.

It is therefore an object of this invention to provide a permanent two-level display device.

It is a further object of this invention to provide such a display device wherein the upper portion thereof is adapted to receive round objects such as muffins and the lower portion is adapted to receive other goods but could also be used to receive muffins and the like.

It is a further object of this invention to provide such a device which is transparent and which readily displays in an attractive fashion the goods placed thereon.

These, together with other objects and advantages of the invention will become more readily apparent to those skilled in the art when the following general statements and descriptions are read in the light of the appended drawings.

DETAILED DESCRIPTION OF THE INVENTION

Figure 1:
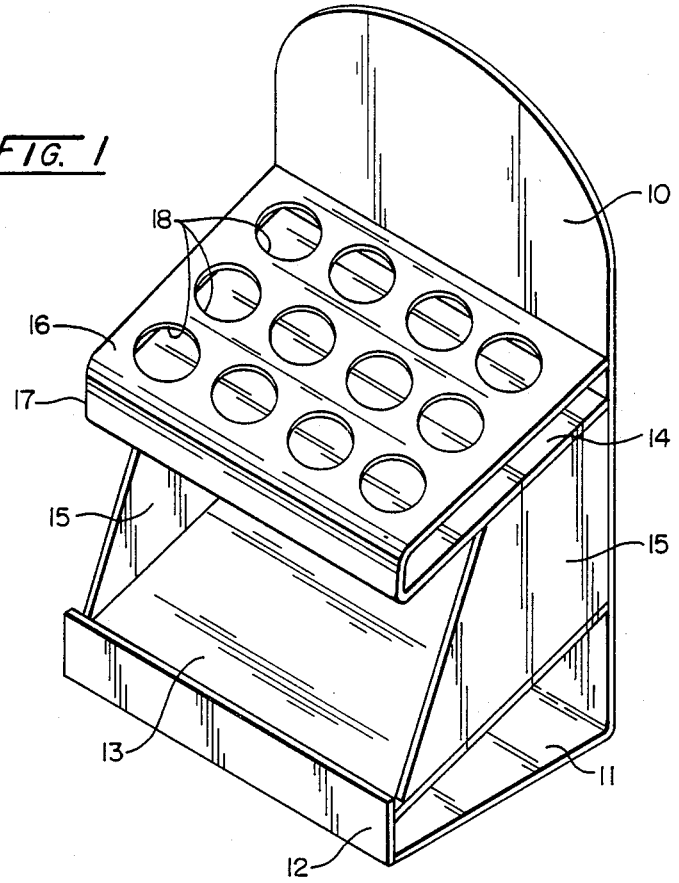
FIG. 1 is a perspective view of the invention.
Figure 2:
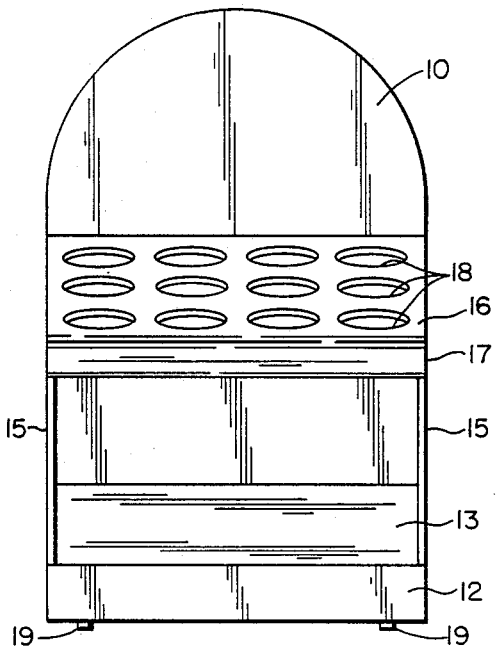
FIG. 2 is a front elevation view of the invention.
Figure 3:
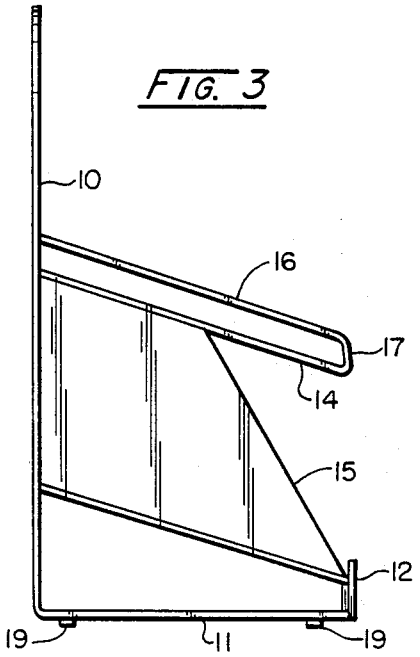
FIG. 3 is a side elevation view of the invention.
Figure 4:
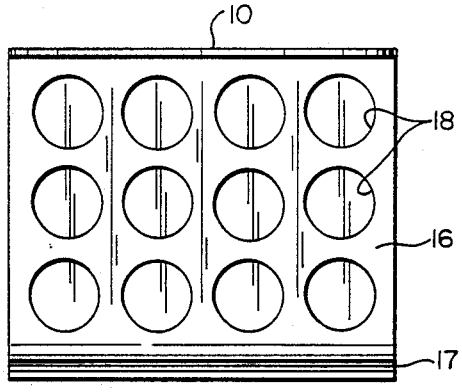
FIG. 4 is an upper plan view of the invention.
Figure 5:
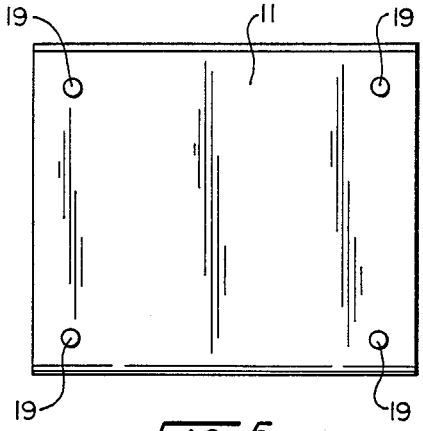
FIG. 5 is an lower plan view of the invention.
Figure 6:
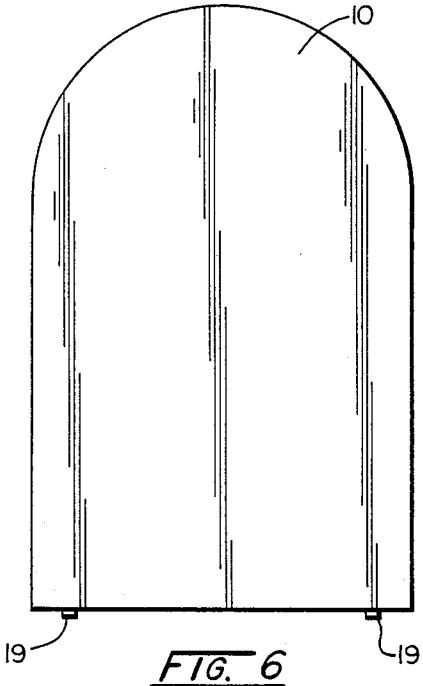
FIG. 6 is a rear elevation view of the invention.

Referring now more particularly to FIG. 1, the back portion 10 is shown connected to a base portion 11. This may be formed from the back portion 10 or may be attached thereto by means of an adhesive. Preferably an upstanding vertical portion 12 is provided attached to the base portion 11 at its side opposite the back portion 10. A lower display rack 13 is attached to the lower portion of the back portion 10, usually by means of an adhesive, and slops downwardly and is connected to the vertical member 12. A downwardly sloping display rack 14 is attached to the back portion 10 and may be supported on each edge by side members 15—15 which are attached to the back portion 10 along its edge thereof and also connected to member 13. Parallel to and spaced from downwardly sloping display member 14 is a second display member 16 which is attached to the back portion 10 and also is attached to and spaced from member 14 by member 17. Preferably member 14, 16, and 17 is made from a single piece of material which has been bent to the appropriate shape. Member 16 is provided with apertures 18—18 which are adapted to receive such goods as muffins or other circular objects. If the objects are smaller than the aperture 18 they can rest on the base member 14.

As shown in FIGS. 2, 3, 5, and 6, base member 11 may be provided with supports 19—19 to space base member 11 from the counter or other location on which it is placed. Members 13, 14, 15, 16, and 17 are preferably made from material such as a Plexiglas® sheet or the like. If all of the elements are made from a clear, transparent Plexiglas® type material the resultant display case is most attractive.

While this invention has been described in its preferred embodiment, it is to be appreciated that variations therefrom may be made without departing from the true scope and spirit of the invention.

I claim:

1. A display case comprising a vertically extending back portion, a base portion having four sides, one side connected to said back portion at the lower extremity of said back portion, and said base portion extending horizontally from said lower extremity of said back portion, a downwardly sloping lower flat display tray portion attached to said back portion adjacent to but spaced from the lower extremity of said back portion and joined to said base portion adjacent to the side of said base portion which side is opposite to the side of said base portion which is connected to said back portion, a first downwardly sloping upper flat display tray portion attached to said back portion adjacent to but spaced from the upper extremity of said back portion, a second downwardly sloping upper flat display tray portion attached to said back portion adjacent to but spaced from the upper extremity of said back portion and positioned above and spaced from said first downwardly sloping upper flat display tray portion, said second downwardly sloping upper flat display tray portion being provided with a plurality of openings therein.

2. The display case of claim 1 wherein said first downwardly sloping upper flat display tray portion and said second downwardly sloping upper flat display tray portion are connected together in the portions thereof which are opposite those portions which are attached to said back portion.

3. The display case of claim 2 wherein means are provided to support said first downwardly sloping upper flat display tray portion on its sides which extend out from said back portion.

4. The display case of claim 3 wherein said means which are provided to support said first downwardly sloping upper flat display tray portion comprises two side support portions, one of which is attached to said back portion and one side of said lower flat display tray portion and the corresponding side of said upper flat display tray portion and the other of said side portions being attached to said back portion and the other side of said lower flat display tray portion and the corresponding other side of said first upper flat downwardly sloping display tray portion.

5. The display case of claim 3 wherein said lower flat display tray portion is joined to said base portion by means of a vertically extending member.

6. The display case of claim 5 in which the downwardly sloping lower flat display tray portion and the first and second downwardly sloping upper flat display tray portion are made out of a transparent material.

7. The display case of claim 5 wherein all of the portions are made of a transparent material.

* * * * *